US009725871B2

(12) United States Patent
Parsons

(10) Patent No.: US 9,725,871 B2
(45) Date of Patent: Aug. 8, 2017

(54) RETAINING WALL KIT HAVING INTERCONNECTING UNITS

(71) Applicant: Marcus Parsons, Charlestown, NH (US)

(72) Inventor: Marcus Parsons, Charlestown, NH (US)

( * ) Notice: Subject to any disclaimer, the term of this patent is extended or adjusted under 35 U.S.C. 154(b) by 0 days.

(21) Appl. No.: 14/596,173

(22) Filed: Jan. 13, 2015

(65) Prior Publication Data

US 2015/0197912 A1 Jul. 16, 2015

Related U.S. Application Data

(60) Provisional application No. 61/926,478, filed on Jan. 13, 2014.

(51) Int. Cl.
*E02D 29/02* (2006.01)
*E04C 1/00* (2006.01)
*E04C 1/39* (2006.01)

(52) U.S. Cl.
CPC ..... *E02D 29/0225* (2013.01); *E02D 29/02* (2013.01); *E02D 29/025* (2013.01); *E02D 29/0266* (2013.01); *E04C 1/395* (2013.01)

(58) Field of Classification Search
CPC .... E02D 29/02; E02D 29/025; E02D 29/0226
USPC ..... 405/284, 286; 52/604
See application file for complete search history.

(56) References Cited

U.S. PATENT DOCUMENTS 4,050,254 A 9/1977 Meheen et al.
4,668,129 A 5/1987 Babcock et al.
5,030,035 A 7/1991 Babcock
5,511,902 A * 4/1996 Center ..... E02D 29/025 405/15
6,010,279 A * 1/2000 Taylor-Smith ..... E04B 2/18 405/286
6,226,951 B1 * 5/2001 Azar ..... E04B 2/16 52/421
6,416,260 B1 * 7/2002 Khamis ..... E02D 29/0241 405/262
6,523,317 B1 * 2/2003 Bott ..... E04C 1/395 256/19
6,663,323 B1 * 12/2003 Boys ..... E02D 29/0225 405/262
6,851,242 B1 * 2/2005 Weatherston ..... E04C 1/395 405/284

(Continued)

*Primary Examiner* — Benjamin Fiorello

(74) *Attorney, Agent, or Firm* — Global Intellectual Property Agency, LLC; Daniel Boudwin

(57) ABSTRACT

Described is a kit for constructing retaining walls including multiple interconnecting units. Various units are provided including primary retaining wall units, end units, and corner units. Each unit is square or rectangular in shape and includes an interior volume, a lip on an upper end thereof, and a protrusion on a lower end thereof. The units can be stacked on top of one another and can be secured by engagement of the lip of a first unit with the protrusion of a second unit. The units can also be arranged side-by-side and secured to one another using securement posts and fasteners. The units include one or more exterior surfaces having a finished appearance that resembles wood, brick, or stone, among others. Further, each unit includes one or more drainage apertures thereon. In this way, the present invention provides a versatile system for constructing a retaining wall of a desired configuration.

9 Claims, 6 Drawing Sheets

(56) References Cited

U.S. PATENT DOCUMENTS

| | | | | |
|---|---|---|---|---|
| 7,934,351 | B2 * | 5/2011 | Clarno | E04C 1/395 405/262 |
| 2002/0043038 | A1 * | 4/2002 | Cerrato | E04B 1/703 52/604 |
| 2007/0151191 | A1 * | 7/2007 | August | E04B 2/54 52/604 |
| 2007/0204548 | A1 * | 9/2007 | Gagne | E04B 2/06 52/604 |
| 2008/0190057 | A1 * | 8/2008 | MacDonald | E02D 29/0225 52/293.2 |
| 2008/0267718 | A1 | 10/2008 | Costin | |
| 2011/0110728 | A1 | 5/2011 | Kim | |
| 2011/0185673 | A1 * | 8/2011 | Ferguson | B28B 7/0064 52/604 |
| 2011/0318100 | A1 * | 12/2011 | Rainey | E02D 29/025 404/6 |

* cited by examiner

RETAINING WALL KIT HAVING INTERCONNECTING UNITS

CROSS REFERENCE TO RELATED APPLICATION

This application claims the benefit of U.S. Provisional Application No. 61/926,478 filed on Jan. 13, 2014. The above identified patent application is herein incorporated by reference in its entirety to provide continuity of disclosure.

BACKGROUND OF THE INVENTION

Field of the Invention

The present invention relates to a system and method for constructing a retaining wall. More specifically, the present invention provides a system and method for constructing a retaining wall using prefabricated, interconnecting units. Each unit comprises a square or rectangular container having one or more finished exterior surfaces, wherein each unit can be filled with a filler material such as mulch, dirt, or gravel, among others. The units can be arranged side-by-side or can be stacked directly on top of one another to create a retaining wall of a desired configuration, wherein the retaining wall includes a continuous outer surface.

Sloped areas of land are susceptible to erosion if not supported or reinforced. This is particularly true for areas that receive heavy rainfall and for areas of land that do not include much vegetation, as the roots of vegetation help to stabilize the slope. As a result, land from the higher elevation of the slope may be deposited on the lower elevation area at the bottom of the slope, and if the erosion is severe, buildings or structures on the higher elevation may be damaged by movement of the land thereunder.

Retaining walls are often used to maintain areas of land at different elevations. Retaining walls are often used in landscaping around homes, businesses, and other areas. However, conventional retaining walls are difficult and time consuming to construct. Further, retaining walls can be expensive when constructed from masonry such as brick or stone, among others. Thus, an easily assembled retaining wall with a decorative appearance is desired in order to provide the benefits of a conventional retaining wall, while facilitating construction thereof.

The present invention provides a system and method for constructing a retaining wall using a plurality of prefabricated, interconnecting units. The units are substantially square or rectangular and include a hollow interior volume to be filled with mulch or gravel. The units include a lip on an upper end thereof and a protrusion on a lower end thereof. The units can be stacked in a vertical configuration and are secured together by engaging the lip of a first unit with a protrusion of a second unit. Further, each unit includes one or more exterior surfaces having a decorative appearance adapted to resemble brick, stone, or wood, among others. The units include drainage holes thereon to allow water to escape the hollow interior thereof. The units include outwardly extending flanges for securing the units in a side-by-side orientation by means of securement posts. Corner and end units are included and allow users to customize the shape and positioning of a retaining wall.

Description of the Prior Art

Devices have been disclosed in the prior art that relate to retaining wall systems. These include devices that have been patented and published in patent application publications. These devices generally relate to apparatuses and methods for constructing retaining walls. The following is a list of devices deemed most relevant to the present disclosure, which are herein described for the purposes of highlighting and differentiating the unique aspects of the present invention, and further highlighting the drawbacks existing in the prior art.

One such device, U.S. Patent Application Publication 2008/0267718 to Costin discloses a retaining wall system wherein blocks are arranged in a stacked orientation to create a wall. Reinforcement strips are inserted into the blocks and extend therefrom in order to anchor the wall and to provide soil reinforcement. Thus, Costin discloses the construction of a retaining wall that involves stacking blocks on top of one another. Costin does not disclose a retaining wall system having a plurality of interconnecting units have interior volumes in which soil or other material can be inserted, and having drainage apertures thereon.

U.S. Patent Application Publication 2011/0110728 to Kim discloses a method for constructing a retaining wall wherein soil bag blocks are staggered. The soil bag blocks are interconnected into a single body using fixing members. Further, a core net is installed on a front portion of the retaining wall so that soil and seeds of plants coated thereon can be germinated on the surface of the retaining wall. Thus, while Kim discloses a method for constructing a retaining wall, Kim fails to disclose a retaining wall constructed from interconnecting units that can be arranged side-by-side, or directly on top of one another, wherein the units are secured together using elongated support rods.

U.S. Pat. No. 5,030,035 to Babcock discloses a retaining wall system that provides landscape terraces. The system utilizes tie-back counterfort elements and wall panels that are aligned so as to create landscaping terraces. In this way, flowers and other plants can be disposed on the front face of the retaining structure. Further, the device of Babcock provides flexibility in constructing retaining walls. However, Babcock fails to disclose a retaining wall system created by interconnecting a plurality of rectangular units having hollow interior volumes in which soil can be disposed.

U.S. Pat. No. 4,050,254 to Meheen et al. discloses a retaining wall constructed from a plurality of tie-back elements that include upright column means. Retaining panel means are arranged to span the lateral space between pairs of tie-back elements. Horizontal legs disposed on the tie-back elements project from the base of the column means and into the soil fill. Each tier is spaced inwardly towards the embankment relative to the next lower tier. Thus, Meheen fails to disclose a retaining wall system comprising interconnecting units that can be arranged side-by-side or stacked on top of one another.

Finally, U.S. Pat. No. 4,668,129 to Babcock et al. discloses a retaining wall system utilizing tie-back elements designed to produce arching in the soil. The tie-back elements include web portions that help to create a complete ditch condition. In this way, the arching in the soil reduces the bearing stresses below the tie-back unit. Thus, Babcock fails to disclose a retaining wall system comprising interconnecting containers in which dirt, soil, mulch, or other filler materials can be positioned.

These prior art devices have several known drawbacks. While devices in the prior art relate to retaining wall structures and methods of constructing the same, the prior art fails to disclose interconnecting containers that can be stacked on top of one another or arranged side-by-side. Instead, the prior art devices generally relate to the formation of tiered retaining wall structures using tie-back elements. The present invention overcomes such limitations by providing an improved retaining wall system that allows users to arrange interconnecting containers in multiple ways to increase versatility to the users.

In light of the devices disclosed in the prior art, it is submitted that the present invention substantially diverges in design elements from the prior art and consequently it is clear that there is a need in the art for an improvement to existing retaining wall devices. In this regard the instant invention substantially fulfills these needs.

SUMMARY OF THE INVENTION

In view of the foregoing disadvantages inherent in the known types of retaining wall systems now present in the prior art, the present invention provides a new retaining wall system wherein the same can be utilized for providing convenience for the user when restraining an elevated slope.

It is therefore an object of the present invention to provide a new and improved retaining wall system that has all of the advantages of the prior art and none of the disadvantages.

It is another object of the present invention to provide a retaining wall system comprising interconnecting retaining wall units that can be secured together in a side-by-side or stacked orientation as desired by the user.

Another object of the present invention is to provide a retaining wall system comprising retaining wall units having a decorative outer surface that resembles masonry such as brick, wood, or stone, among others.

Yet another object of the present invention is to provide a retaining wall system comprising various retaining wall units, such as primary retaining wall units, corner units, and end units that allow the user to construct a retaining wall of a desired size and configuration.

Another object of the present invention is to provide a retaining wall system comprising retaining wall units that include a lip on an upper end thereof and a protrusion on a lower end thereof so that multiple retaining wall units can be easily stacked on top of one another.

A further object of the present invention is to provide a retaining wall system comprising a stair unit that can be used to create a stairwell from a lower portion of the retaining wall to an upper portion thereof.

Yet another object of the present invention is to provide a retaining wall system comprising a fence on the upper end of the retaining wall units that is composed of posts and rails.

An additional object of the present invention is to provide a retaining wall system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
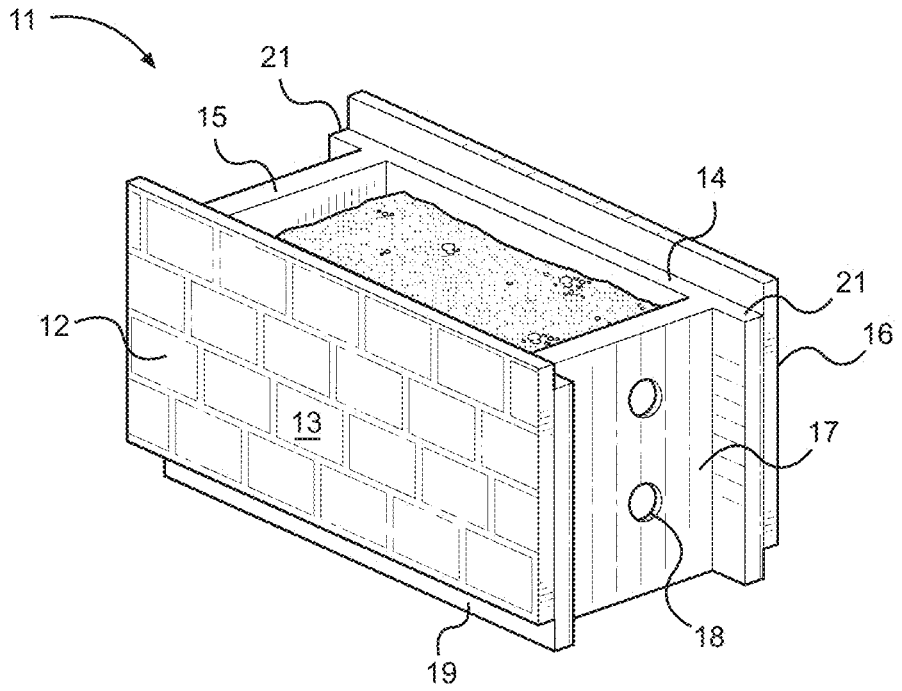
FIG. 1A shows a perspective view of an embodiment of a primary retaining wall unit of the present invention.

Reference is made herein to the attached drawings. Like reference numerals are used throughout the drawings to depict like or similar elements of the retaining wall system of the present invention. For the purposes of presenting a brief and clear description of the present invention, the preferred embodiment will be discussed as used for quickly and easily constructing a retaining wall having an aesthetically pleasing outer appearance. The figures are intended for representative purposes only and should not be considered to be limiting in any respect.

Figure 1B:
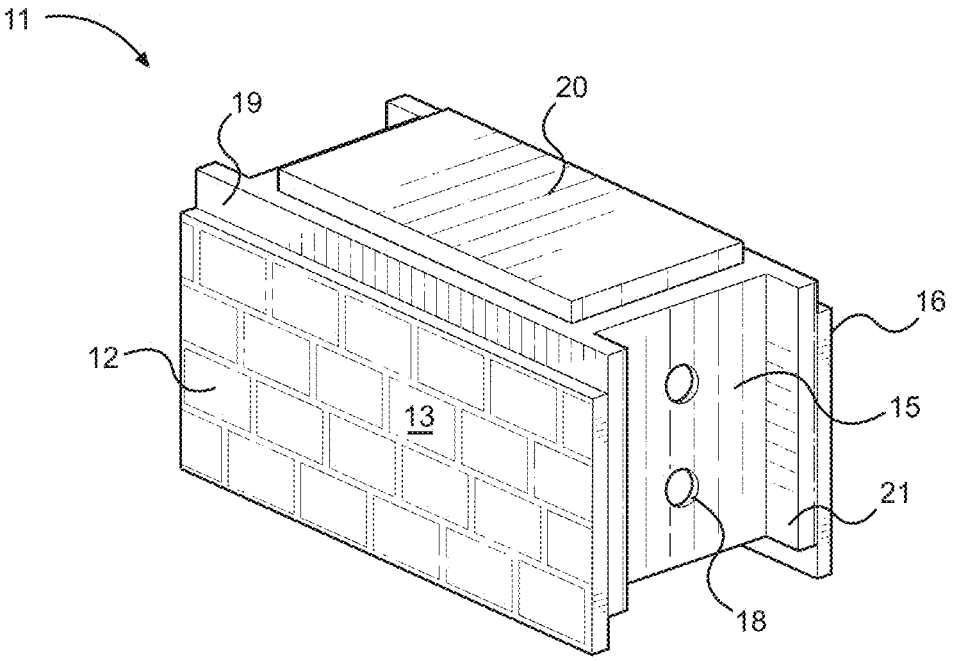
FIG. 1B shows a perspective view of the underside of an embodiment of a primary retaining wall unit of the present invention.

Referring now to FIGS. 1A and 1B, there are shown perspective views of an embodiment of a primary retaining wall unit of the present invention. The present invention describes a retaining wall system wherein a retaining wall can be constructed using a plurality of pre-constructed retaining wall units. The retaining wall units include primary retaining wall units 11, corner retaining wall units, support units, and end retaining wall units.

Each primary retaining wall unit 11 comprises a substantially rectangular container having a bottom end, a front wall 12, a rear wall 16, a pair of sidewalls 15, 17 and an open upper end, defining an interior volume. The container is preferably constructed of a durable, yet lightweight material such as aluminum or steel, among others. The front surface 13 of the front wall 12 of the unit 11 preferably comprises a finished appearance adapted to resemble wood, brick, stone, or other masonry or building materials. The rear surface of the unit 11 may also comprise a finished appearance, or may be unfinished. The sidewalls 15, 17 of the primary retaining wall unit 11 are unfinished. The finished appearance of the front and optionally the rear wall provides the retaining wall unit 11 with a more aesthetically pleasing appearance than a flat, unadorned metal or concrete surface, as is common in traditional retaining walls.

The interior volume of the retaining wall units 11 may be filled with a filler material such as dirt, soil, mulch, or gravel, among others. The filler material helps to provide weight to the retaining wall unit 11 in order to resist movement of each unit. Further, the filler material helps to improve the integrity of the retaining wall units by supporting the walls thereof. The retaining wall units 11 can serve as a planter and can be used to grow flowers or other plant-life as desired by the user.

The sidewalls 15, 17 comprise one or more drainage apertures 18 thereon. Preferably, the drainage apertures 18 are arranged in a square configuration, however, in alternate embodiments the drainage apertures 18 may have other configurations. In some embodiments, the rear wall 16 includes one or more drainage apertures 18 thereon. The drainage apertures 18 allow water that accumulates within the interior volume of the retaining wall unit 11 to escape from the interior volume. Without proper drainage, the contents of the retaining wall unit 11 may cause increased pressure on the walls of the retaining wall unit, causing damage thereto.

The retaining wall units 11 are adapted to be stacked directly on top of one another and the upper end of a first unit is adapted to mate with the bottom end of a second unit, so the units can be secured to one another in a vertical orientation. In the illustrated embodiment, the front and rear walls 12, 16 of the primary retaining wall unit 11 extend above the interior surfaces of the unit 11, forming an interior lip 14 therealong. Further, the sidewalls 15, 17 are the same height as the inner surfaces of the unit 11 and are lower than the front and rear walls 12, 16. In this way, the front and rear walls 12, 16 serve to bound the interior of the primary retaining wall unit 11. Further, the bottom end of the unit 11 includes a protrusion 20 positioned centrally thereon. The protrusion 20 of a first unit 11 is adapted to be placed on the lip 14 of a second unit 11 such that the first and second units 11 are secured together by engagement of the protrusion within the lip 14. When the protrusion 20 of a first unit 11 is stacked on top of the lip 14 of a second unit 11, the front wall 12 of the first and second units 11 are aligned, forming a continuous surface. The units 11 can be stably and securely stacked on one another in this manner. The sidewalls 15 and rear walls 16 of the units 11 align when the units 11 are stacked. Additionally, the lower end of the front and rear walls 12, 16 may include a channel 19, such that the front and rear walls 12, 16 do not contact the ground. This area provides space for the upper ends of the front and rear walls 12, 16 of a second retaining wall unit. In this way, multiple retaining wall units can be stacked in a vertical orientation and can fit snugly together in a mating arrangement, forming a continuous front wall with no gaps or spaces.

Figure 2:
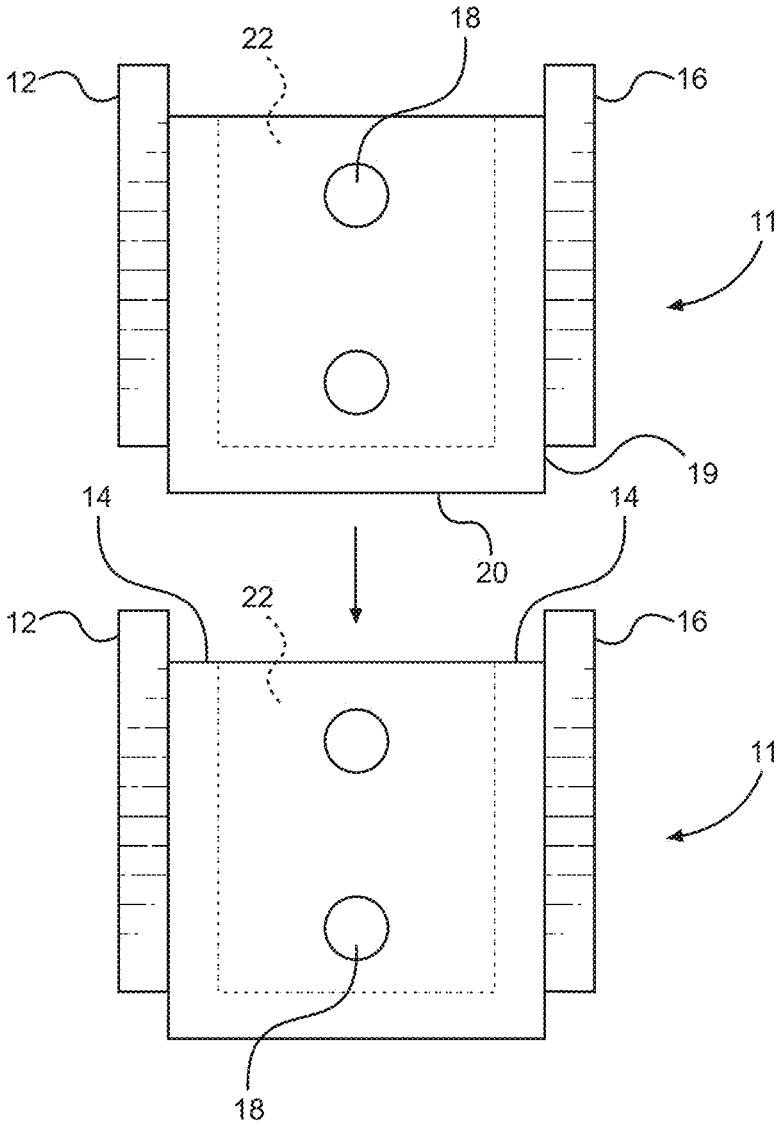
FIG. 2 shows a side planar view of retaining wall units as arranged in a stacked orientation.

Referring now to FIG. 2, there is shown a view of retaining wall units in a stacked configuration. The retaining wall units 11 are adapted to be stacked directly on top of one another as shown in order to increase the height of the retaining wall. The retaining wall units are stacked such that the front walls 12 of the retaining walls are aligned in substantially the same plane. This allows the retaining wall to appear to have a continuous surface 13 in order to provide an aesthetically pleasing appearance. Similarly, the rear walls 16 of the units 11 are aligned when the units 11 are stacked on one another so as to form a continuous surface. The protrusion 20 is sized so as to be received within the lip 14 on the upper end of a unit 11, and fits tightly therein. Further, the upper ends of the front and rear walls 12, 16 of a first retaining wall unit are positioned within the channel 19 on the lower end of a second retaining wall unit.

Figure 3A:
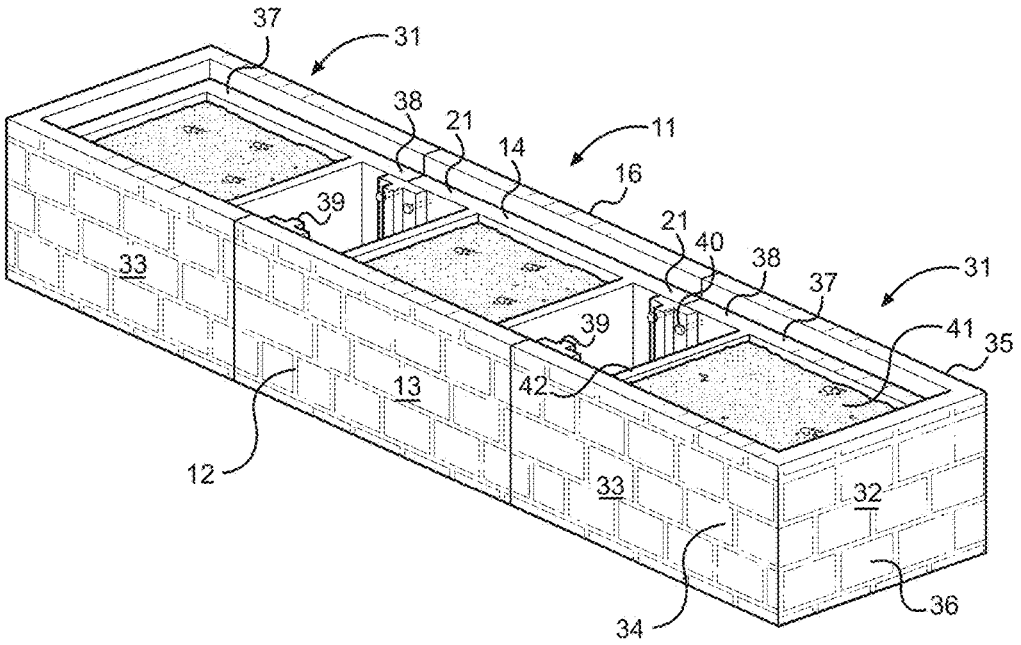
FIG. 3A shows a top-down view of retaining wall units as arranged in a side-by-side orientation.
Figure 3B:
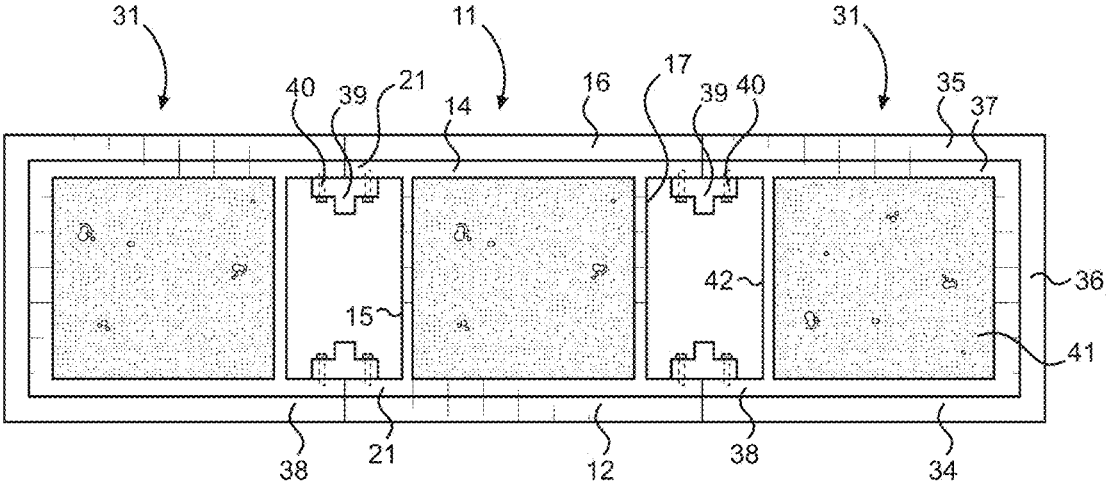
FIG. 3B shows a perspective view of retaining wall units as arranged in a side-by-side orientation.

Referring now to FIGS. 3A and 3B, there are shown views of retaining wall units arranged in a side-by-side orientation. In order to form a retaining wall, multiple primary retaining wall units 11 can be arranged in a side-by-side orientation in order to achieve a retaining wall of the desired length. Each of the front wall 12 and the rear wall 16 comprises flanges 21 that extend outward therefrom that are coplanar with the front wall 12 and rear wall 16. The flanges 21 are the same height as the front and rear walls 12, 16 and include an interior lip 14 thereon. Thus, the flanges 21 are a continuation of the front and rear walls 12, 16.

In operation, the flanges 21 on the sides of a first retaining wall unit can be positioned end-to-end with the flanges on the side of a second retaining wall unit. In this way, the front walls of the retaining wall units form a continuous surface. Similarly, the surfaces of the rear walls of the retaining wall units form a continuous surface. Once positioned side-by-side, a securement post 39 can be used to secure the flanges on the first and second retaining wall unit to one another.

The securement post 39 is an elongated post disposed in a vertical, upright orientation. Preferably, the securement post 39 comprises a T-shaped cross section. The securement post 39 is positioned flush against a flange on a first retaining wall unit and a flange on a second retaining wall unit. A plurality of fasteners 40, such as a bolts, can be inserted through the securement post 39 and into the flanges of the retaining wall units. In this way, the securement post 39 secures a pair of retaining wall units to one another. This helps to eliminate shifting or movement of the retaining wall once constructed. Further, the securement posts 39 are disposed behind the front wall of the retaining wall units so that the securement posts 39 are not visible once the retaining wall is constructed.

The present invention further provides end retaining wall units 31 that are used to provide a finished appearance to the end of a retaining wall constructed in accordance with the present invention. The primary retaining wall units 11 include pairs of flanges 21 on opposing sides thereof, and the sidewalls of the primary retaining wall units 11 do not have a finished exterior. As a result, the ends of a retaining wall constructed using only primary retaining wall units 11 would have an unfinished appearance. Accordingly, end retaining wall units 31 are provided.

End retaining wall units 31 are similar in construction to primary retaining wall units 11. Each end retaining wall unit 31 comprises a rectangular or square shaped container having a bottom end with a protrusion thereon, a front wall 34, a rear wall 35, a first sidewall 36, a second sidewall 42, and an open upper end, defining an interior volume that can be filled with filler material 41. The front wall 34, rear wall 35, and first sidewall 36 are each the same height and form a perimeter of the unit. An inner lip 37 extends around the interior of the unit 11 and the second sidewall 42 is the same height as the inner lip 37. Thus, the end retaining wall units can be stacked in the same manner as described above for primary retaining wall units.

The end retaining wall unit 31 also comprises a single pair of flanges 38 extending from the second sidewall 42 thereof. The flanges 38 are coplanar with the front and rear walls 34, 35 and are the same height. Further, the flanges 38 include an inner lip 37 along the inner surface thereof. In this way, the flanges 38 of the end retaining wall unit 31 can be aligned with the flanges 21 of a primary retaining wall unit 11 and the inner lips 37, 14 thereof form a continuous surface. The area enclosed by the intersection of the pair of retaining wall units can also be filled with filler material similar to the individual retaining wall units.

The side of the end retaining wall unit 31 having flanges 38 may additionally include one or more drainage apertures thereon. Similarly, the rear wall 35 may comprise one or more drainage apertures thereon. The sidewall 36 lacking the pair of flanges comprises a finished exterior surface 32. In this way, the end retaining wall unit 31 provides a finished outward appearance.

Figure 4A:
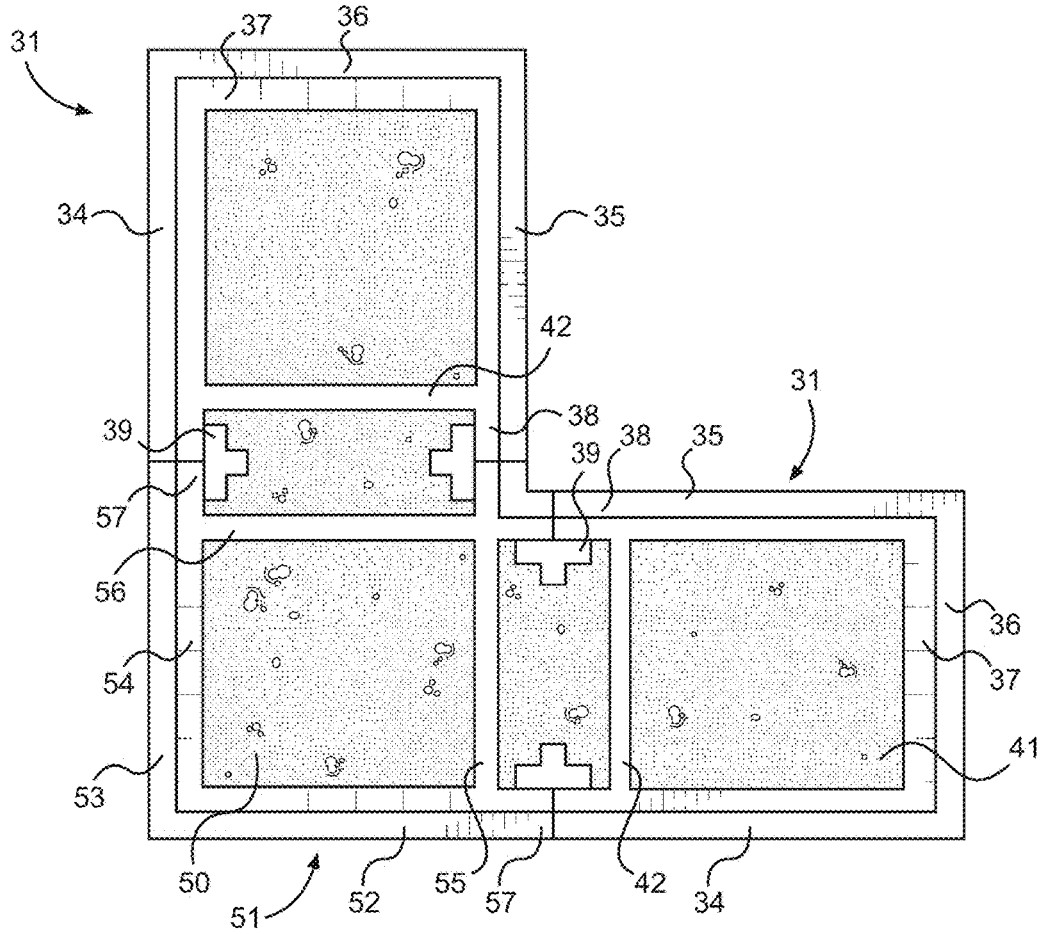
FIG. 4A shows a top-down view of a corner retaining wall unit of the present invention.
Figure 4B:
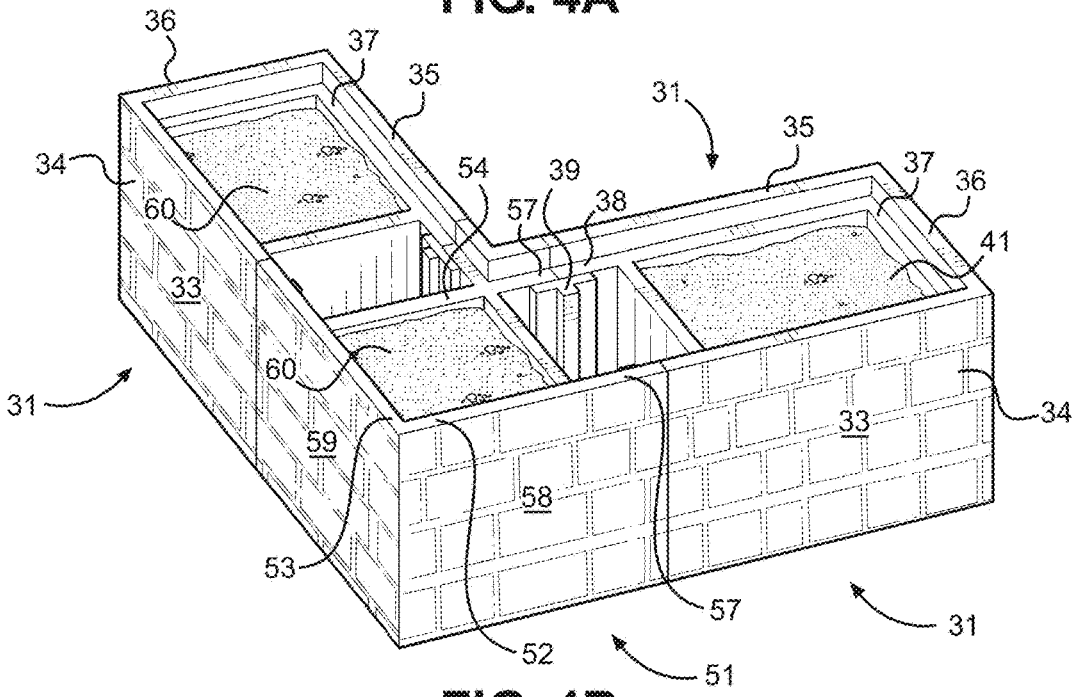
FIG. 4B shows a perspective view of a corner retaining wall unit of the present invention.

Referring now to FIGS. 4A and 4B, there are shown views of a corner retaining wall unit of the present invention. The corner retaining wall unit 51 comprises a container having a bottom end, a front wall 52, a rear wall 56, a first sidewall 53, a second sidewall 55, and an open upper end, defining an interior volume that can be filled with filler material 50. The front wall 52 comprises a finished surface 58 and one of said first 53 or second sidewalls 55 comprises a finished surface 59 that resembles masonry such as brick, wood, or stone, among others. The rear wall 56 and one of said first or second sidewalls 55 are unfinished and comprises a pair of flanges 57 thereon. The front wall 52 and first sidewall 53 include an inner lip 54, and the rear wall 56 and second sidewall 55 are the same height as the inner lip 54.

The flanges 57 on the corner retaining wall unit 51 can be disposed end-to-end with the flanges on a primary retaining wall unit or with the flanges on an end retaining wall unit. A securement post 39 can be used to secure the corner retaining wall unit 41 to a second retaining wall unit in a side-by-side fashion, as described above. In this way, the corner retaining wall unit 41 can be secured to two retaining wall units to form a corner for the retaining wall.

It is contemplated that the height of the front wall 52 and the finished sidewall 53 is substantially equal to the height of the front and rear walls of the primary retaining wall unit 11. Further, the flanges 57 include a lip 54 thereon that is equal to the height of the lip on the primary or end retaining wall unit so as to form a continuous surface when aligned with an additional retaining wall unit. The corner retaining wall unit also includes a protrusion on the bottom end thereof so that multiple corner units 41 can be stacked on top of one another to increase the height of a retaining wall.

Figure 5:
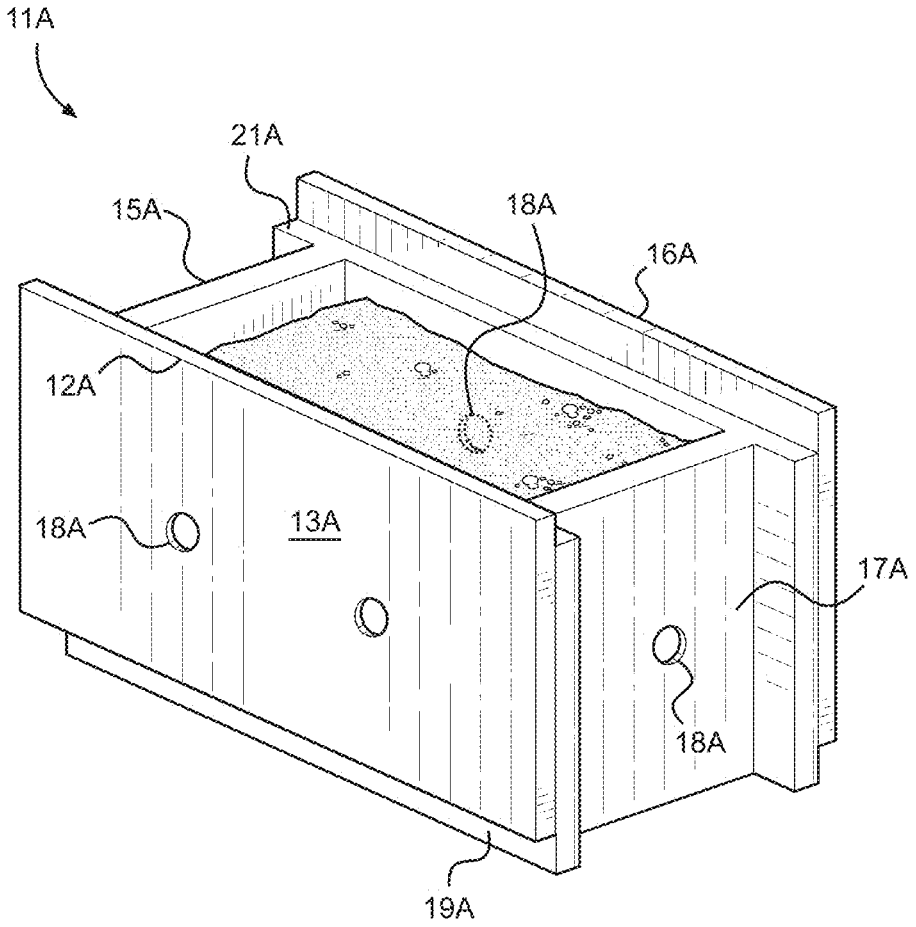
FIG. 5 shows a perspective view of a support unit of the present invention.

Referring now to FIG. 5, there is shown a view of a support unit of the present invention. The support unit 11A is substantially similar to the primary retaining wall unit as shown in FIGS. 1A and 1B. The support unit 11A includes a front wall 12A, a rear wall 16A, and a pair of sidewalls 15A, 17A. The support unit 11A includes an interior volume that can be filled with filler material. The support unit 11A includes one or more drainage apertures 18A on the front wall 12A, rear wall 16A, and sidewalls 15A and 17A. The front wall 12A and rear wall 16A extend above the sidewalls 15A and 17A and include an inner lip. The bottom of the support unit 11A further includes a protrusion thereon adapted to be positioned on the upper portion of a second support unit 11A so that the units can be vertically stacked. Thus, the support units 11A can be stacked in the same manner as the other retaining wall units. Further, the front and rear walls 12A, 16A may include a channel 19A along the bottom thereof for receiving the upper ends of the front and rear walls of another retaining wall unit.

In operation, the support units 11A can be placed in a hole in the ground so as to provide support for a retaining wall built using the retaining wall units of the present invention. The primary retaining wall units and other units having finished surfaces can then be placed thereon, so that they are above ground level. Alternatively, the support units 11A can be placed in a row behind primary retaining wall units so as to provide lateral support thereto. The support units 11A are not visible when in use and thus do not include any finished surfaces. Further, since the support units 11A are arranged adjacent to other retaining wall units, and may be surrounded thereby, the support units 11A include a plurality of drainage apertures 18A on each of the walls thereof. The drainage apertures 18A are positioned similarly to the drainage apertures 18A on the other retaining wall units so that they can be aligned therewith when used to construct a retaining wall.

Figure 6:
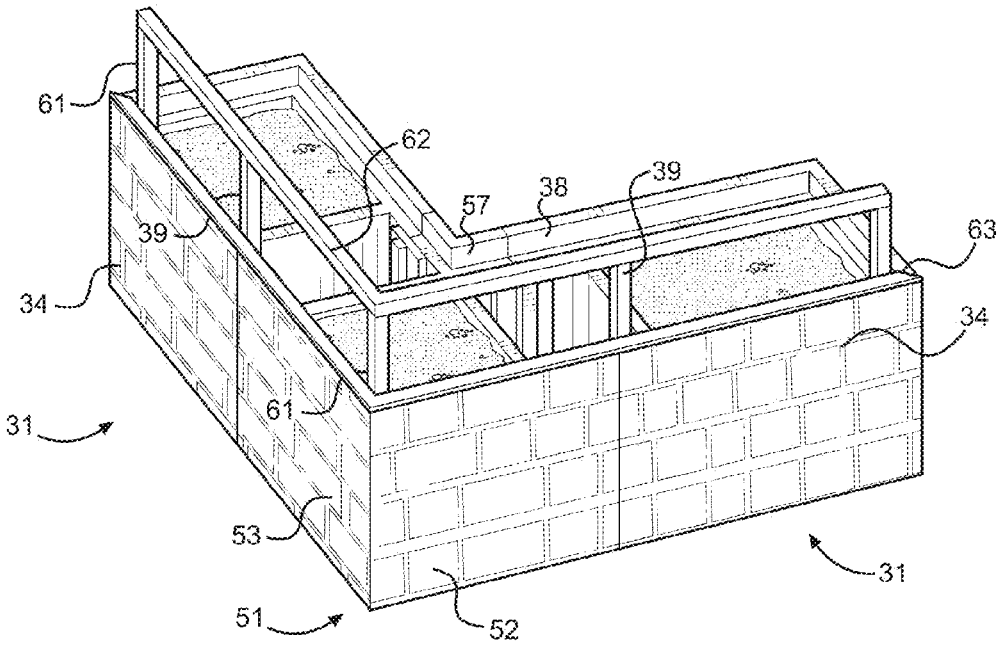
FIG. 6 shows a perspective view of the post and rails of the present invention as positioned on a retaining wall.

Referring now to FIG. 6, there is shown a perspective view of the post and rails of the present invention as positioned on a retaining wall. The present invention further includes a plurality of posts and rails for creating a fence or barrier on the upper end of the retaining wall constructed in accordance with the present invention. A post 39 is placed at the intersection between two retaining wall units 31, 51 so as to secure the two retaining wall units 31, 51 to one another. In the illustrated embodiment, the post 39 is used to secure the end retaining wall unit 31 to the corner retaining wall unit 51 and extends above the retaining wall units 31, 51. The post 39 preferably has a T-shaped cross section, but may have alternate cross sections in other embodiments.

Further, L-shaped posts 61 are provided for use at the corners of the retaining wall. The L-shaped posts 61 are positioned in a corner retaining wall unit 51 or in an end retaining wall unit 31 and are secured thereto via any suitable fasteners, such as nails or bolts, among others. An upper rail 62 is positioned horizontally along the upper end of the posts 39, 61 so as to connect the same. The upper rail 62 can be secured thereon via fasteners or via welding, adhesives, or other fastening methods. Additionally, a lower rail 63 is positioned on the upper end of the retaining wall so as to fill in the inner lip thereof. In this way, the upper end of the retaining wall is flush and does not include a recessed area thereon. The lower rail 63 also includes an L-shaped cross section, but may include other cross sections in alternate embodiments of the present invention.

Figure 7:
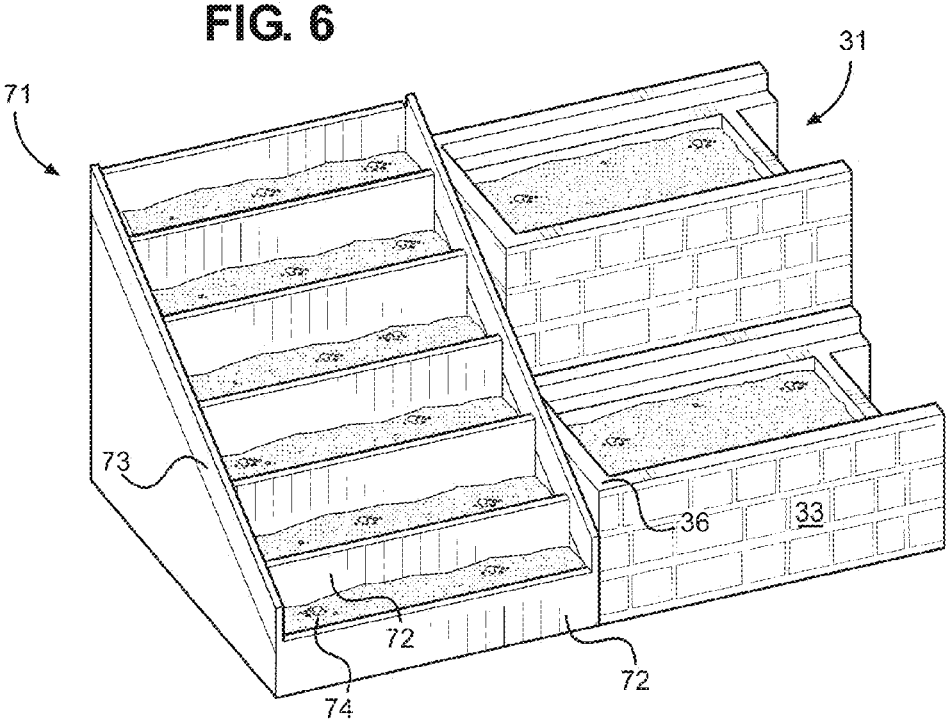
FIG. 7 shows a perspective view of the stair unit of the present invention.

Referring now to FIG. 7, there is shown a perspective view of the stair unit of the present invention. The present invention further provides a stair unit 71 that includes a substantially rectangular unit having a series of steps thereon. The stair unit 71 is sized similarly to the primary retaining wall units so that the upper end of the stairs is the same height as that of the primary retaining wall unit. The stair unit 71 includes a pair of support rails 73 having a quadrilateral shape. The support rails 73 extend upward at an angle so as to create an incline. A plurality of kick plates 72 are secured to the support rails in a perpendicular orientation. The kick plates 72 are rectangular and are positioned vertically. The stair unit 71 further includes a hollow interior volume, and the horizontal section of each step is open so that the stair unit can be filled with filler material 74, and the filler material 74 can serve as the horizontal surface of each step.

The stair unit 71 can be arranged adjacent to end retaining wall units 31 so that the finished sidewall is positioned against the side of the stair unit 71. In this way, the stair unit 71 can be placed flush against the sidewall 36 of the end retaining wall units 31. Multiple stair units 71 can be arranged so as to create a longer set of stairs that extends to the top of the retaining wall constructed in accordance with the present invention.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retaining wall system, comprising:

a plurality of retaining wall units having a rectangular shape comprising a bottom end, a first sidewall opposite a second sidewall, a front wall opposite a rear wall, and an open top, defining an interior volume;

wherein each of an upper end of said front wall and an upper end of said rear wall includes an inner lip;

wherein said bottom end includes a protrusion thereon adapted to be received by said inner lip of a retaining wall unit;

wherein said plurality of retaining wall units each includes one or more pairs of flanges extending outward therefrom;

one or more posts disposed in a vertical orientation and adapted to secure a flange of a first retaining wall unit to a flange of a second retaining wall unit;

wherein said one or more posts are secured to said flange of said first retaining wall unit and said flange of said second retaining wall unit via fasteners.

2. The retaining wall system of claim 1, wherein said first sidewall and said second sidewall include one or more drainage apertures thereon.

3. The retaining wall system of claim 1, wherein said front wall of said plurality of retaining wall units comprises an ornamental appearance adapted to resemble wood, brick, or stone.

4. The retaining wall system of claim 3, wherein one of said first or second sidewalls comprises an ornamental appearance adapted to resemble wood, brick, or stone.

5. The retaining wall system of claim 1, wherein said flanges are coplanar with said front wall and said rear wall.

6. The retaining wall system of claim 1, wherein said plurality of retaining wall units further comprises:

at least one primary retaining wall unit comprising a container having a bottom end, a front wall, a rear wall, a first sidewall, a second sidewall, and an open upper end, defining an interior volume;

at least one end retaining wall unit comprising a container having a bottom end, a front wall, a rear wall, a first sidewall, a second sidewall, and an open upper end, defining an interior volume;

at least one corner retaining wall unit comprising a container having a bottom end, a front wall, a first sidewall, a second sidewall, a rear wall, and an open upper end defining an interior volume;

wherein one of said first side wall or said second side wall of said at least one primary retaining wall unit is connected to one of said first side wall or said second side wall of said at least one end retaining wall unit;

wherein one of said first side wall or said second side wall of said at least one primary retaining wall unit is connected to one of said rear wall, said first side wall, or said second side wall of said at least one corner retaining wall unit.

7. The retaining wall system of claim 1, wherein said one or more posts each comprise a T-shaped cross section.

8. The retaining wall system of claim 1, wherein one or more rails are affixed horizontally on said one or more posts so as to create a fence.

9. The retaining wall system of claim 1, further comprising a stair unit having a hollow interior volume adapted to be filled by a filler material;

a pair of support rails disposed on opposing sides of said stair unit, wherein said pair of support rails are parallel to one another;

a plurality of kick plates disposed between said pair of support rails, wherein said plurality of kick plates are separated from one another at an interval.

* * * * *